United States Patent [19]

Sterwerf, Jr.

[11] Patent Number: 4,632,463

[45] Date of Patent: Dec. 30, 1986

[54] COMBINED BASE MEMBER AND BIT HOLDER WITH PROTECTED RETAINER

[75] Inventor: Lester J. Sterwerf, Jr., Harrison, Ohio

[73] Assignee: The Cincinnati Mine Machinery Company, Cincinnati, Ohio

[21] Appl. No.: 637,319

[22] Filed: Aug. 3, 1984

[51] Int. Cl.[4] ..... E21B 10/00

[52] U.S. Cl. ..... 299/91; 299/93

[58] Field of Search ..... 299/91, 92, 93, 86; 175/410, 354, 413; 173/114, 111; 407/46, 47, 101, 102, 120; 279/1 E, 1 A; 403/165, 379; 172/120, 540; 37/141 T, 142 R; 384/903, 539

[56] References Cited

U.S. PATENT DOCUMENTS

| | | | |
|---|---|---|---|
| 3,397,012 | 8/1968 | Krekeler | 299/86 |
| 4,247,150 | 1/1981 | Wrulich et al. | 299/86 |
| 4,302,053 | 11/1981 | Roepke et al. | 299/86 |
| 4,582,364 | 4/1986 | deMey, III | 299/92 |

FOREIGN PATENT DOCUMENTS

| | | | |
|---|---|---|---|
| 2092205 | 8/1982 | United Kingdom | 299/91 |

*Primary Examiner*—James A. Leppink
*Assistant Examiner*—Matthew Smith
*Attorney, Agent, or Firm*—Frost & Jacobs

[57] ABSTRACT

The combined base member and bit holder with protected retainer which comprises this invention includes a bit holder adapted to receive the shank of a suitable cutting bit. The bit holder has a head which permits movement of the bit holder within the base member so as to expose means to receive a retaining member while that portion of the bit holder protrudes beyond the base member. The base member is provided with an opening or recess to receive the retainer so as to prevent accidental dislodgement. After installation of the retainer the bit holder is moved within the base member so as to engage the retainer at least partly in the recess provided in the base member for it, whereafter a spacer is driven between the head of the bit holder and body of the base member to hold the bit holder in place. A boss may be provided on the base member to prevent undue movement of the spacer. Means may also be provided in conjunction with the boss and/or base member to prevent the legs of the spacer from being spread so that the spacer also is prevented from accidental dislodgement. The bit holder may be provided with a flat to let it pass by the boss or it may be provided with a notch to receive the boss when the bit holder is moved to its initial position for installation of the retainer.

36 Claims, 28 Drawing Figures

COMBINED BASE MEMBER AND BIT HOLDER WITH PROTECTED RETAINER

TECHNICAL FIELD

This invention has particular use in the mining, road planing and earth digging fields. More specifically, the invention relates to arrangements by which a bit lug having a socket therein to receive a bit is located in a base member. The bit lug is provided with a retainer for releasably securing it within the base member. The instant invention resides in a relationship among the bit lug, base member and retainer such that when these parts are in their assembled, operative condition the retainer is protected from damage and from accidental removal by the forces and abrasive conditions encountered during a mining, road planing or earth moving operation.

BACKGROUND ART

The present invention is especially applicable to mining machines and the like of the type having a primary drive member to which is affixed one or more base members each adapted to receive a bit lug which in turn receives a bit or cutting tool. The drive member, which in turn is driven by appropriate mechanisms, may take a number of forms such as a chain, a rotating wheel, a rotating drum, or a rotating arm and the like. The bits or cutting tools, which may also be those found in machinery other than mining, such as road working and earth moving equipment, may also take various forms such as mining machine cutter bits, road ripping elements, digger teeth and the like.

The bit lug, also known in the trade as a bit block or bit holder, may receive various kinds of bits or cutting elements. To this end the lug is provided with a perforation designed to receive the shank of the particular style of bit for the particular work to be performed. The precise relationship between the bit lug and bit does not constitute a direct part of the instant invention. Various means may be provided for retaining the bit or cutting element within the lug; again these do not constitute a direct part of the instant invention. By the same token the invention is not directly concerned with the particular kind of equipment to which the base member, that which receives the bit lug, is affixed. The invention is primarily concerned with the manner by which the bit lug is secured within a cavity provided for it in the base member. As indicated herein, means are provided to retain the bit lug within the base member and the invention is directly concerned with protecting these latter means.

No search of the prior United States patent art has been made in connection with this invention. It is known, however, that there are many patents which show various relationships between bit lugs and base members. Prior art workers recognized the importance of providing arrangments by means of which the bit lug itself, as distinguished from the bit per se, could be easily and readily removed from the respective base member in which it was mounted. A number of "pin-on", "wedge-on" and other arrangements were developed for accomplishing such result. U.S. Pat. No. Re. 28,310 discloses a popular "pin-on" arrangement for securing a bit lug to a base member. Various "wedge-on" arrangements are shown in U.S. Pat. Nos. 3,342,531; 3,834,764; 4,057,294; 4,275,929 and 4,337,980. (Patents such as U.S. Pat. Nos. 3,397,012 and 3,622,206 disclose various means and arrangements for enabling quick and easy removal of a bit from a bit lug. Other such means and arrangements are shown in U.S. Pat. Nos. 2,965,365 and 3,114,537.)

There is other art which is at least indirectly pertinent. U.S. Pat. Nos. 3,679,265 and 3,888,133, for example, show chains made up of various interdigitated bit-carrying links, connecting links, spacers, connecting pins and retaining means. U.S. Pat. No. 3,888,133 is of interest in that it does disclose an arrangement by which the means to retain a connecting pin within a number of connecting links, bit-carrying links and spacers is prevented from being accidentally dislodged and is protected from wear. Some of the principles of this latter patent are adopted for use in the instant invention. In this connection, U.S. Pat. No. 3,397,012 (FIG. 12) is also of interest.

DISCLOSURE OF THE INVENTION

The combined base member and bit holder with protected retainer which comprises this invention includes a relationship between the base member and bit holder such that the bit holder may be inserted within the perforation provided for it in the base member and moved to an initial position wherein the retainer may be placed on an end of the bit holder which protrudes outside of the base member, whereafter the bit holder is moved axially so as to bring the retainer at least partially within the base member, and then a spacer is mounted between the head of the bit holder and the front of the base member to maintain the bit holder and base member in proper relationship. In one embodiment of the invention a boss is provided on the base member and the spacer comprises a split ring the ends of which will engage about the sides of the boss. In other embodiments of the invention means are provided to capture the ends of the spacer so as to prevent the spacer from being spread by the forces encountered during the mining or other operation, thereby ensuring that the spacer will stay in place and the bit holder and base member remain in operative condition with the retainer held in a protected position. In some embodiments of the invention the bit holder is provided with a flat to enable it to clear the boss. In other embodiments of the invention the head of the bit holder is provided with a notch to receive the boss when the bit holder is moved to its initial position for insertion of the retainer. Some embodiments also include another notch to enable a drift or the like to be inserted between the spacer and bit holder so as to enable the spacer to be removed when it is necessary to replace the bit holder.

In all of the embodiments the arrangement is such that when the bit holder and base member are in their operative position the means which retains the bit holder within the base member is at least partly protected by the base member. This protects the retainer from damage by the conditions encountered during the working operation and it also prevents inadvertent removal of the retainer whereby to ensure that the bit holder is securely held within the base member at all times.

BRIEF DESCRIPTION OF THE DRAWINGS

FIG. 17 is a sectioned side view of a modified assembled bit holder, base member combination.

FIG. 18 is a view taken on the line 18—18 of FIG. 17.

DETAILED DESCRIPTION OF THE INVENTION

Figure 12:
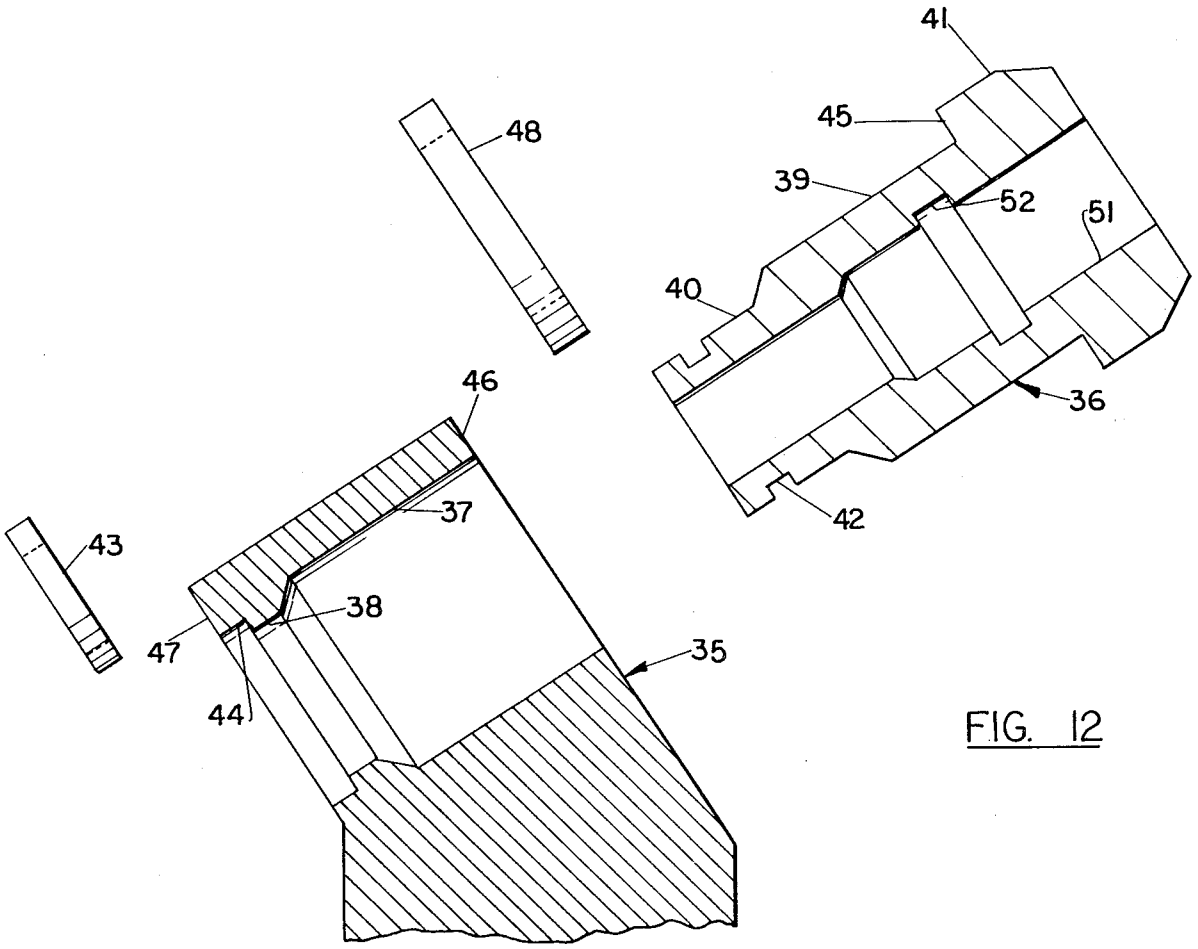
FIG. 12 is an exploded assembly view, partly in section, of a somewhat different type of bit holder along with the base member, retainer and spacer comprising one modification of the invention.
Figure 13:
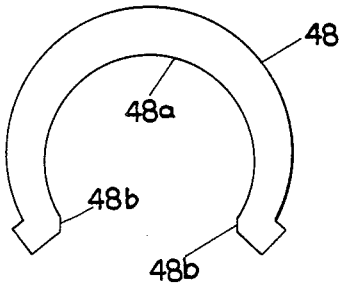
FIG. 13 is a plan view of a modified spacer.
Figure 14:
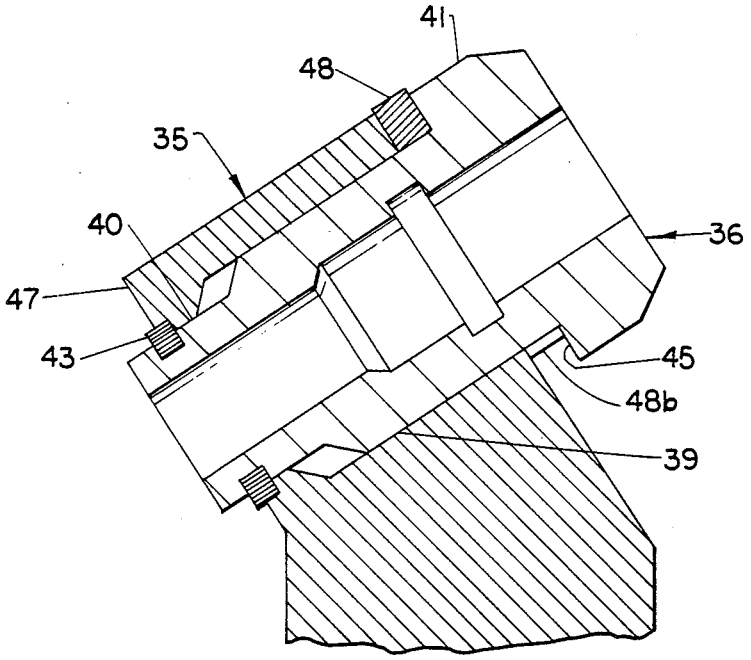
FIG. 14 is a view, partly in section, showing the bit holder, base member, retainer and spacer of FIGS. 12 and 13 in their assembled condition.

Referring first to FIGS. 12–14, the basic invention is disclosed. A base member 35 is depicted as adapted to receive therein a bit holder 36. To this end the base member 35 is provided with a perforation having diameters 37 and 38 adapted to receive the corresponding portions 39 and 40 of the bit holder 36. The bit holder 36 also has an annular head 41 adapted to overlie the perforation 37. The bit holder also has an annular groove 42, in this instance, adapted to receive an annular retainer 43 which may be resilient in nature. The base member 35, in this instance, is provided with an annular undercut or notch 44 adapted to receive the retainer 43.

To assemble the bit holder within the base member, the bit holder is inserted through the perforations 37 and 38 to a position where the rear face 45 of the annular head 41 may abut the front face 46 of the base member 35 at which point the notch 42 in the bit holder 36 will project beyond the rear face 47 of the base member 35 so that the retainer 43 may be located directly in the groove 42. The bit holder 36 is then moved axially in the opposite direction within the base member 35 so as to create a space between the bit holder head rear face 45 and the base member front face 46 so that a spacer 48 can then be engaged about the bit holder portion 39 between the two faces 45 and 46. The relationship is such as to ensure that this brings the retainer 43 at least partially within the notch 44 whereby the retainer is protected from the forces and fines encountered during a mining operation, for example, and the retainer is also prevented from being inadvertently dislodged.

From the foregoing, therefore, it will be observed that the bit holder 36 is first placed within the base member 35 so that the groove 42 is accessible from the rear face 47 of the base member 35, the retainer 43 is then installed in the bit holder groove 42, and after this the spacer 48 is installed between the faces 45 and 46. In this manner the retainer 43 is brought into the base member and at least partially received in the base member notch 44 for restraint and protection. It should be observed that this relationship is such that the bit holder may also rotate within the perforation provided for it in the base member.

The spacer 48 may have any appropriate cross-section. The inner curvature 48*a* of the retainer is such that the ends 48*b* will have to be spread apart in order to pass around the bit holder portion 39 and in order that the spacer 48 will be arranged about such portion 39 when it is driven home. The distance between the ends of the legs 48*b* will be somewhat less than the outer diameter of the bit holder portion 39. The inner diameter 48*a* of the spacer 48, however, is preferably slightly greater than the outer diameter of the bit holder portion 39. The spacer 48 will have spring tension built into it due to its shape and/or the material from which it is made.

The arrangement of FIGS. 12–14 demonstrates the basic invention of providing a relationship among the base member 35, bit holder 36, retainer 43 and spacer 48 such that the retainer is drawn at least partly within the base member so as to be protected from undue wear and dislodgment. That particular arrangement, however, while generally satisfactory, does present some problems. Except for its frictional engagement with the bit holder face 45 and base member face 46, and with the bit holder portion 39 via the leg ends 48*b*, there is nothing to prevent the spacer 48 from rotating and this could cause undue wear. Additionally, fines and the like may accumulate between the leg ends 48*b* and the open overhang of the bit holder face 45 in the region of such ends. Furthermore, there is less bearing area for the underface 45 of the bit holder head 41. These possible shortcomings, however, may be overcome in various ways as will now be discussed.

Figure 2:
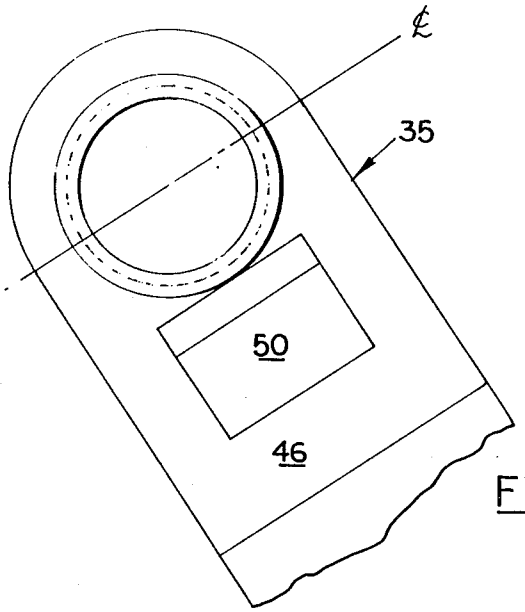
FIG. 2 is an auxiliary view of the base member of FIG. 1 and taken from the right side thereof, looking along the axis of the perforation which will receive a bit holder.
Figure 1:
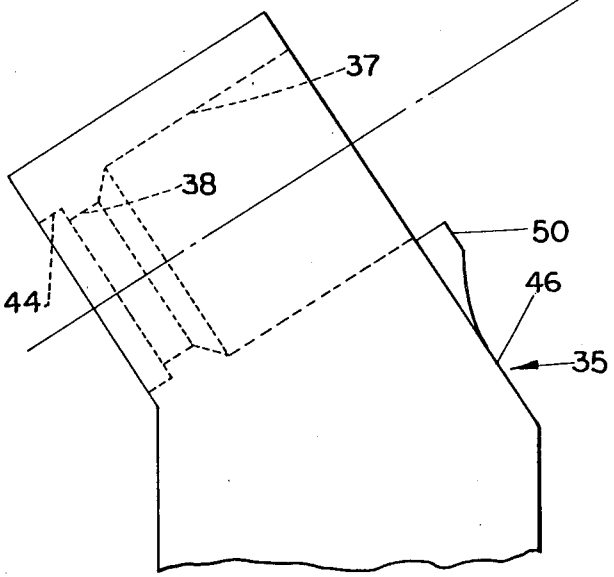
FIG. 1 is a side elevation of the main portion of a base member comprising a part of the invention.
Figure 3:
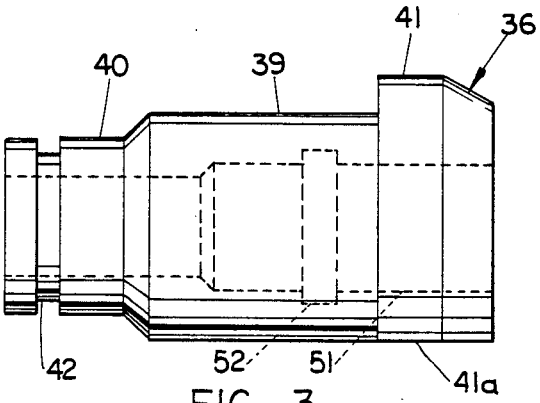
FIG. 3 is a side elevation of a bit holder used in this invention.
Figure 4:
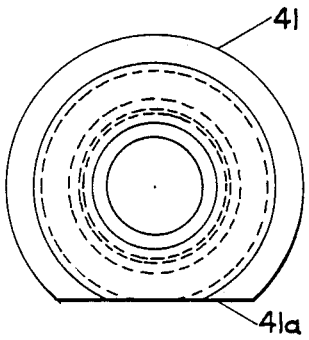
FIG. 4 is an end view of the bit holder of FIG. 3 taken from the right side thereof.
Figure 5:
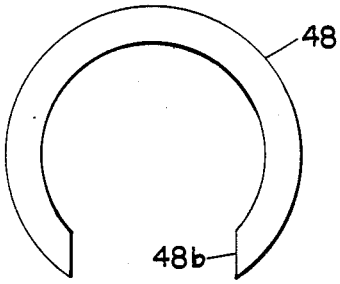
FIG. 5 is a plan view of a spacer which may be used with this invention.
Figure 6:
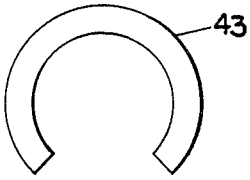
FIG. 6 is a plan view of one type of retainer which may be used with this invention.

In the various figures like reference numerals will be used to designate like parts. Thus, referring now to FIGS. 1–9, a base member 35 is again illustrated as having coaxial perforations 37 and 38 designed to receive the portions 39 and 40 of a bit holder 36. The retainer to be received within the annular groove 42 is shown in this instance as comprising a split ring 43 (FIG. 6). This retainer 43 will eventually be received within the annular groove 44 provided in the base member 35. The spacer is also indicated in this instance as comprising a split ring 48 (FIG. 5).

The arrangement of FIGS. 1–9 so far described is like that of FIGS. 12–14 but modifications have been made. First, the base member 35 has been provided with a boss 50 on its front face 46 adjacent the perforation 37 and having its major thickness being substantially the same as the thickness of the spacer 48, see FIG. 8. This boss 50 provides additional bearing area for the rear face 45 of the bit holder head 41; it also serves to prevent rotation of the spacer 48 by reason of the fact that the ends **48*b* of the spacer are adapted to straddle the sides of the boss 50, see FIG. 9**.

Second, the bit holder of FIGS. 1–9 has also been modified. The head 41 of the bit holder 36 has been provided with a flat **41*a* substantially in line with the outer diameter of the bit holder portion 39. This enables the head 41 to clear the boss 50 when the bit holder is inserted within the base member for installation of the retainer 43, see FIG. 7. Preferably at this point, with head face 45 abutting the base member front face 46,. there is a small clearance between the shoulders 37*a* and 39*a***.

Figure 8:
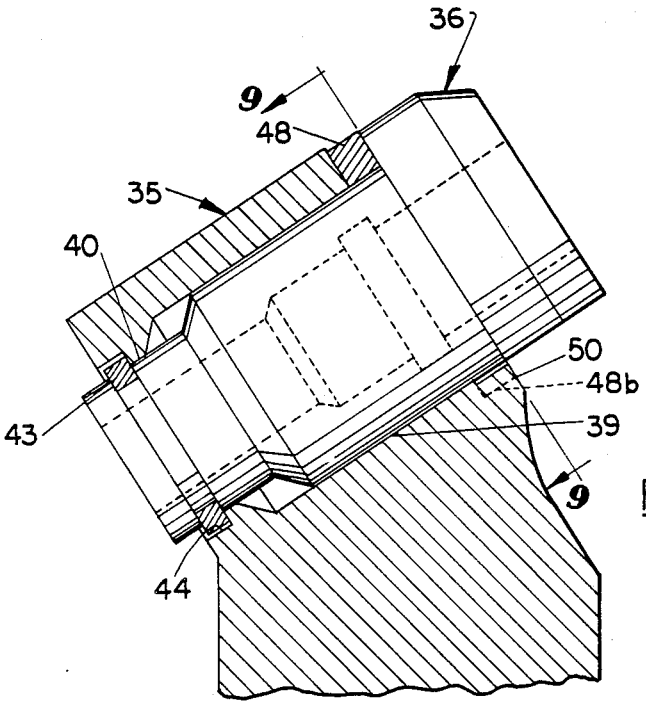
FIG. 8 is an assembly view showing the bit holder of FIG. 3 located within its final position in the base member of FIG. 1, the retainer having been placed on the bit holder when in the FIG. 7 position and the spacer having been driven home in the FIG. 8 position.
Figure 9:
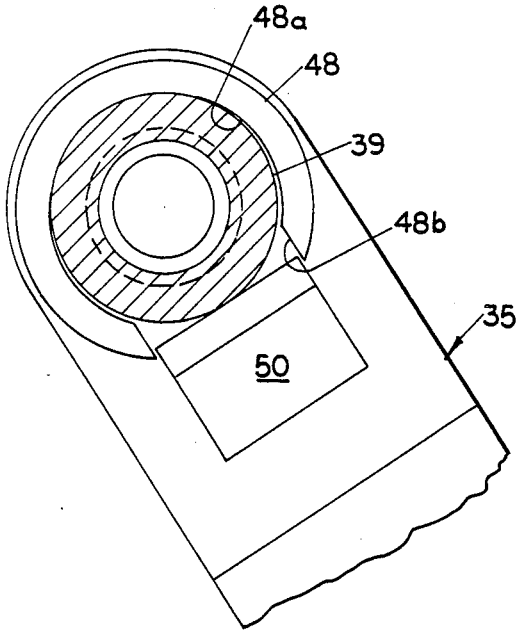
FIG. 9 is a cross-section taken on the line 9—9 of FIG. 8.

Third, the relationship among the parts has also been modified somewhat in that, in this particular embodiment, when the spacer 48 is installed the retainer 43 is drawn completely within the base member 35 as permitted by the annular notch or groove 44, see FIG. 8.

In all of the depictions so far discussed the bit holder 36 has been illustrated as provided with a shank receiving perforation 51 to receive the shank of a cutting bit (not shown) and an annular notch or groove 52 to receive some sort resilient retainer (also not shown) to maintain the bit shank within the perforation 51. As noted earlier, however, the exact nature of the bit and the manner in which it is held within the bit holder do not constitute a limitation on this invention.

Figure 10:
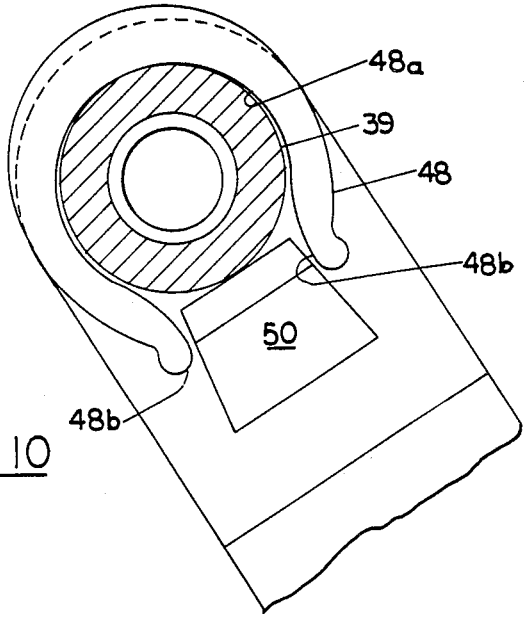
FIG. 10 is a view similar to FIG. 9 but showing a modified spacer and boss.

FIG. 10 depicts a slightly different arrangement and relationship between the spacer 48 and boss 50. The side walls of the boss 50 are shown as slightly tapered towards the perforation 37 which receives the bit holder portion 39, and the ends **48*b* of the spacer 48 are slightly curved. This makes the spacer easier to install. This also depicts the type of clearance fit preferred between the inner diameter 48*a* of the spacer 48 and the outer diameter of the bit holder portion 39**.

Figure 11:
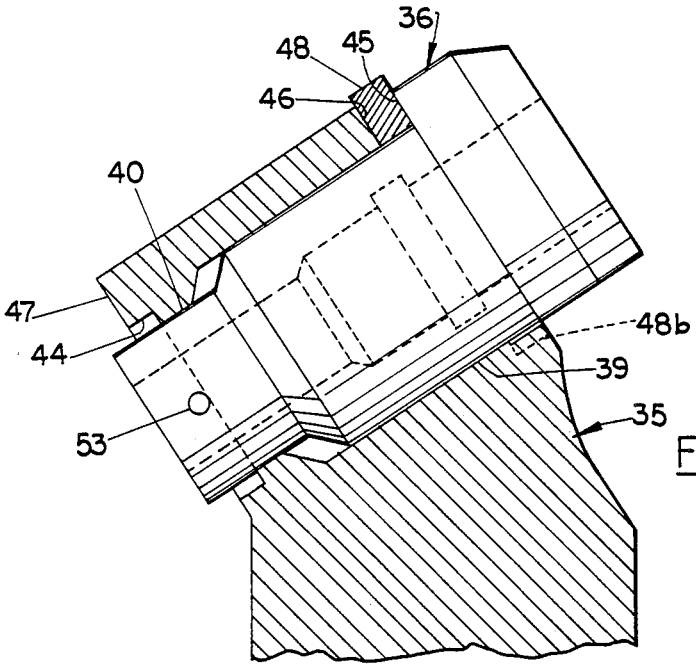
FIG. 11 is a view similar to FIG. 8 but showing a different type of retainer.

FIG. 11 is generally similar to FIG. 8 but it illustrates the use of a roll pin 53 in place of the retainer 43; this roll pin will be press fitted into a hole provided for it towards the end of the bit holder 36 when that end extends beyond the rear face 47 and the exposed ends of this pin will eventually be received within the groove 44 as shown in this FIG. 11.

The various arrangements of FIGS. 1–11 do prevent the spacer 48 from shifting position once it is installed between the head 41 of the bit holder 36 and the front face 46 of the base member 35, and its free ends **48*b* brought into engagement with the sides of the boss 50. In some instances, however, the forces and fines encountered during mining operations, for example, are so severe as to cause the spacer legs to be spread apart whereupon the spacer may be lost and eventually even the bit holder. Various structures for preventing this are illustrated in FIGS. 15–22**. Again, like reference numerals are used to designate like parts throughout the figures.

Figure 16:
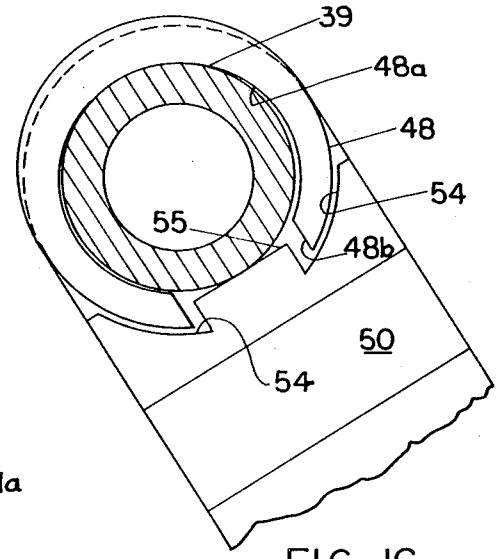
FIG. 16 is a view taken on the line 16—16 of FIG. 15.
Figure 15:
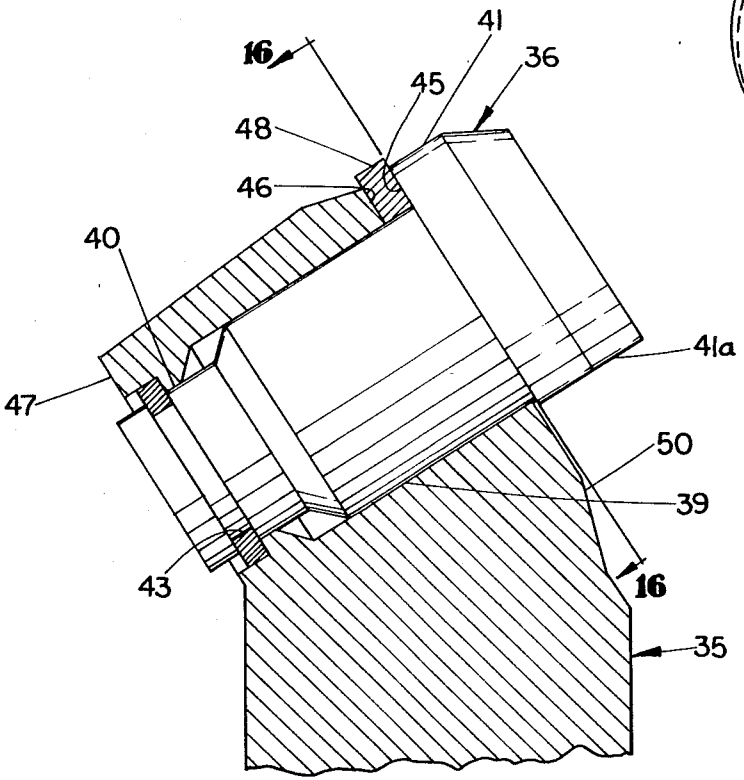
FIG. 15 is a sectioned side view of a modified bit holder, base member assembled combination.
Figure 13:
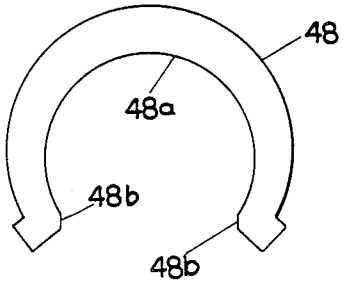
Figure 14:
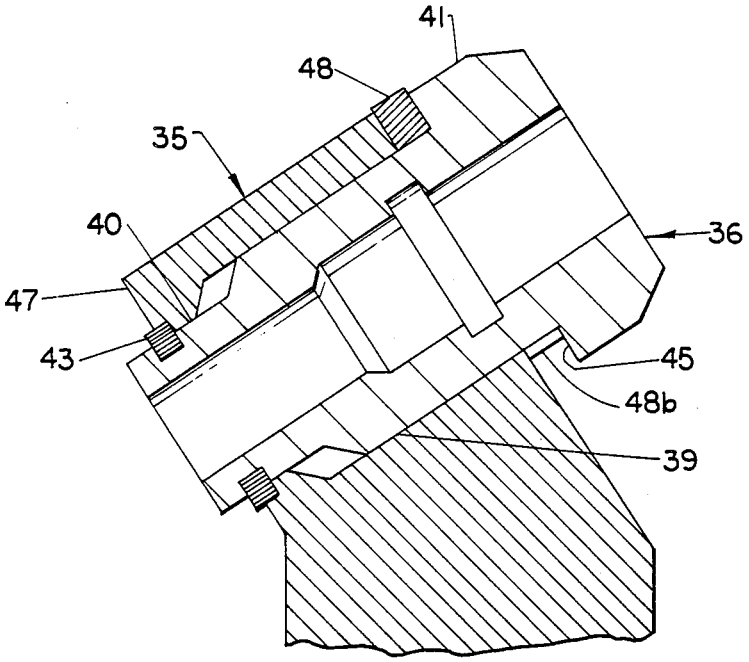

In the arrangement of FIGS. 15–20 the boss 50 has been illustrated as extending clear across the base member 35. In FIGS. 15 and 16 the boss 50 is depicted as provided with a pair of arcuate indentations 54 into which the free leg ends **48*b* of the spacer 40 are forced when the spacer 48 is driven home. In FIG. 16 the ends 48*b* do not contact the side walls of the boss extension 55 although this could be arranged if desired. It will be apparent, however, that by locating the spacer ends 48*b* within the arcuate indentations 54 it will make it very difficult for the forces encountered to spread the spacer legs 48 enough to permit the spacer 48** to be lost.

The arrangment of FIGS. 17 and 18 is generally similar to that of FIGS. 15 and 16 differing primarily in the type of notch **54*a* provided in the boss 50. The side walls of the boss extension 55 are tapered so as to direct the curved ends 48*b* of the spacer 48 into the arcuate socket-like notches 54*a*. This is generally like the arrangement of FIG. 10 but with the enlarged boss 50 modified to provide the additional notches 54*a*. When the spacer 48 is driven home the curved leg ends 48*b* will pass into the notches 54*a* and engage the notch overhang 54*b*. This prevents the legs from being spread and maintains the spacer 48 in desired position whereby to retain the bit holder 36 within the base member 35. The arrangement is again such that the retainer 43 is completely located within the arcuate groove or notch 44**.

Figure 20:
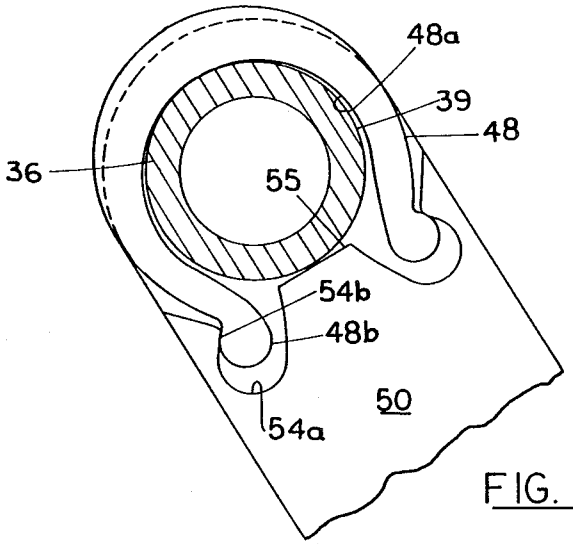
FIG. 20 is a view taken on the line 20—20 of FIG. 19.
Figure 19:
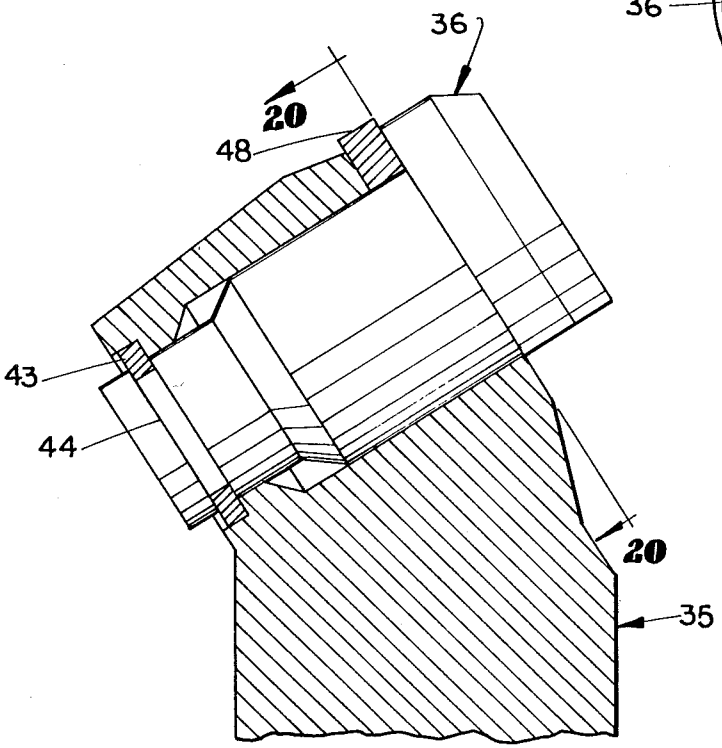
FIG. 19 is a sectioned side view of another modification of assembled bit holder and base member.

The arrangement of FIGS. 19 and 20 is generally similar to that shown in FIGS. 17 and 18 except that the legs **48*b* do not contact the tapered sides of the boss extension 55 and the boss, notch overhang 54*b*** is more pronounced.

Figure 22:
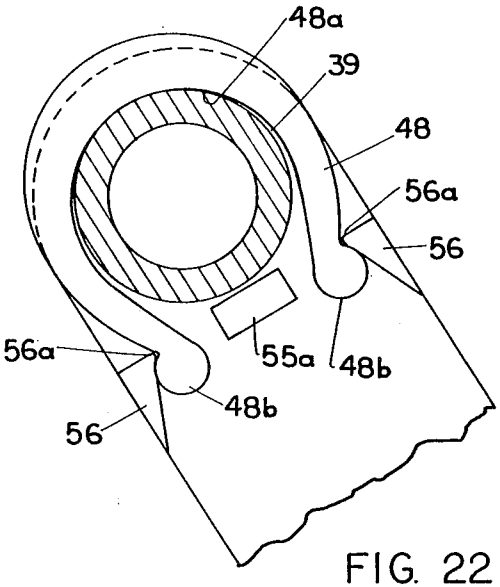
FIG. 22 is a view taken on the line 22—22 of FIG. 21.
Figure 21:
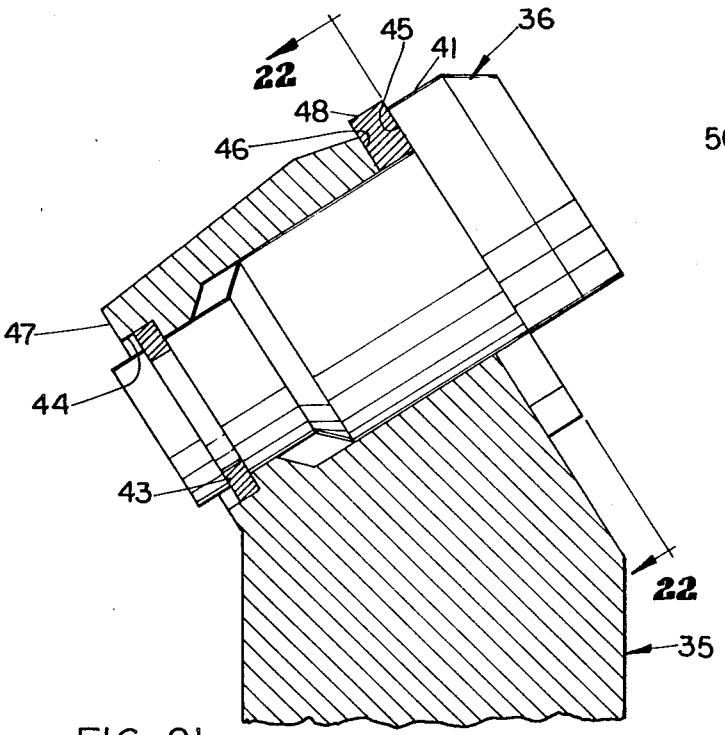
FIG. 21 is a sectioned side view of another modification of assembled bit holder and base member.

The arrangement of FIGS. 21 and 22 is somewhat different in that the kind of boss illustrated in FIGS. 15–20 has been eliminated and replaced by a pair of members 56. These members 56 have an inwardly protruding surface **56*a* past which the ends 48*b* of the spacer 48 are forced when the spacer is driven home between the face 45 of the head 41 of the bit holder 36 and the front face 46 of the base member 35. When the leg ends 48*b* snap into place beneath the overhang 56*a*, such overhang will resist spreading of the spacer and thereby prevent its accidental dislodgement from the combination of bit holder, base member, retainer and spacer. A modified boss-like member 55*a*** may also be utilized.

Figure 7:
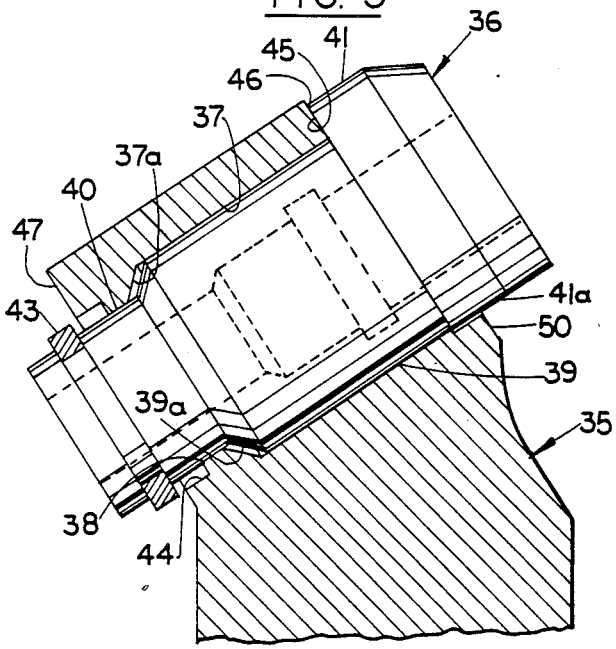
FIG. 7 is an assembly view, partly in section, showing the bit holder of FIG. 3 located in its initial position within the base member of FIG. 1.
Figure 23:
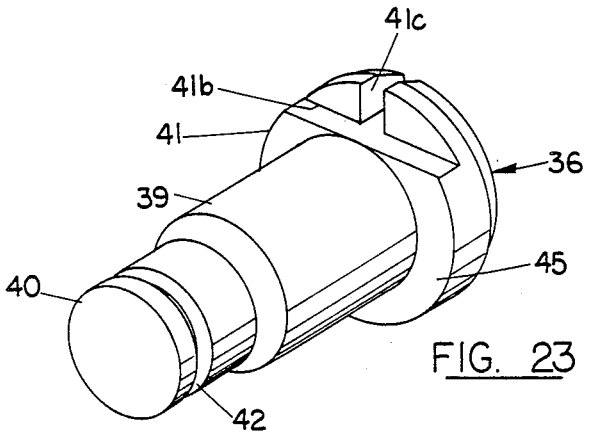
FIG. 23 is a perspective view of another embodiment of a bit holder which may comprise a part of the invention.
Figure 24:
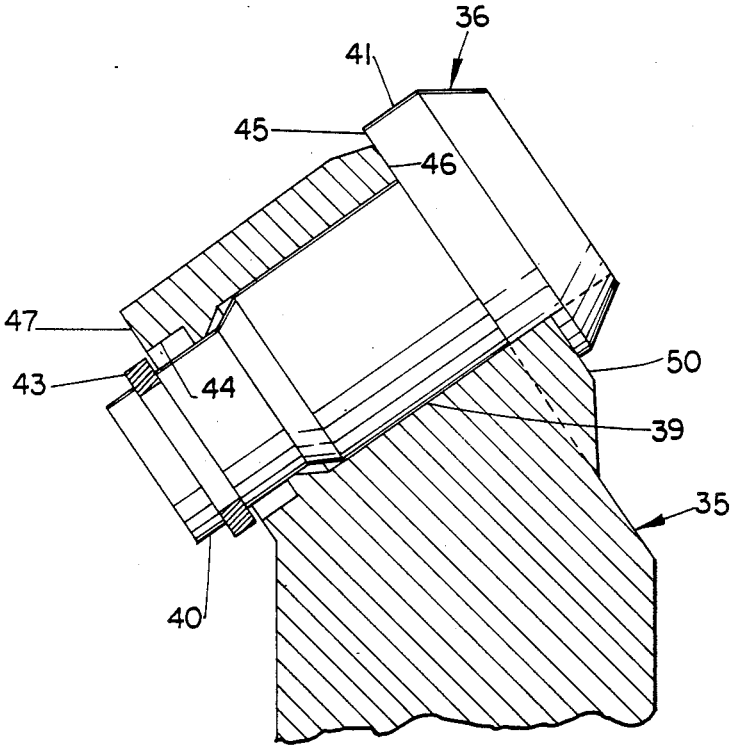
FIG. 24 is a sectioned side view showing the initial position of the modified bit holder of FIG. 23 located within a base member generally like that of FIG. 1.
Figure 25:
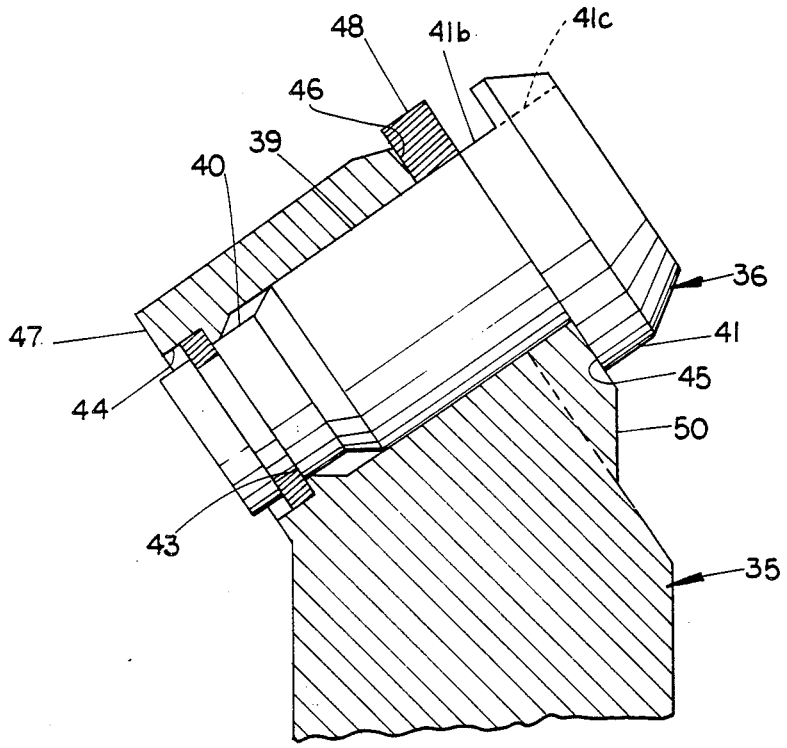
FIG. 25 is a sectioned side view showing the combination of FIG. 24 in its completely assembled condition following placement of the retainer on the bit holder and the driving home of the spacer.

FIGS. 23–25 illustrate an embodiment of the invention which incorporates a full-headed bit holder similar to that shown in FIG. 12, (i.e., one without a flat therein such as the flat indicated at **41*a* in FIG. 7), with a base member 35 having the boss 50 thereon. To this end the bit holder 35 has the head 41 thereof provided with a transverse notch 41*b*. The notch 41*b* is sufficient to accommodate the boss 50. The bit holder 36 is first placed within the base member 35 so that the boss 50 is received in the notch 41*b*; at this point the lower face 45 of the bit holder head 41 will abut the front face 46 of the base member and the retainer groove 42 will project beyond the bottom or rear face 47 of the base member so that the retainer 43 may be installed in the groove 42. At that point the bit holder may be pulled outwardly so that the retainer 43 is received within the groove 44 and then the bit holder 36 may be rotated so that the bit holder head face 45 rests on the boss 50. This simplifies the installation of the spacer 48 since the operator does not have to hold the bit holder 36 in position; the boss 50 and face 45 do this for him as is also true in other embodiments, e.g., that of FIGS. 7 and 8. The spacer 48 is then driven home and the arrangement of spacer 48 and boss 50 may be like that shown in various of the other figures, e.g., FIGS. 12–14**.

FIGS. 23–25 also illustrate another feature of the invention, namely, the provision of a second, vertical notch 41*c* which may be used should it become necessary to withdraw the spacer 48 so as to change bit holders 36. The notch 41*c* has been illustrated in the FIGS. as located centrally of the notch 41*b* but this is not a fixed requirement. The notch 41*c* may be located anywhere around the periphery of the head 41 of the bit holder 36. The purpose of the notch 41*c* is to permit insertion of a drift or the like to be engaged between the spacer 48 and bit holder body portion 39. The notch 41*c* could, of course, also be incorporated in others of the various bit holder heads 41 illustrated throughout these drawings.

Figure 26:
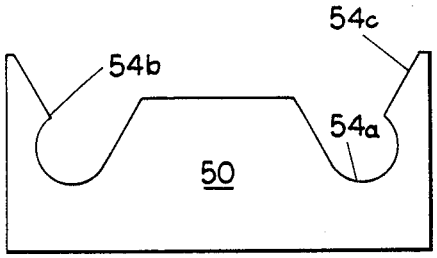
FIG. 26 is a plan view of a modified boss.
Figure 27:
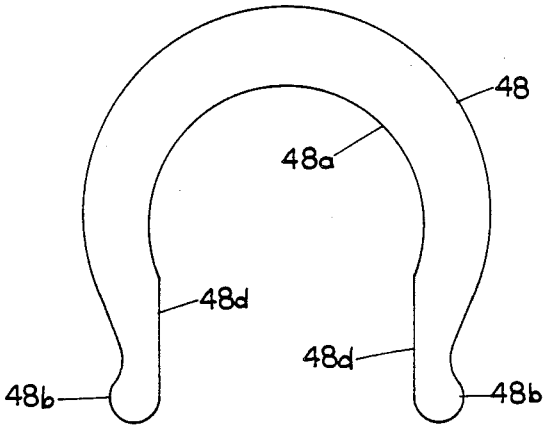
FIG. 27 is a plan view of a modified spacer.
Figure 28:
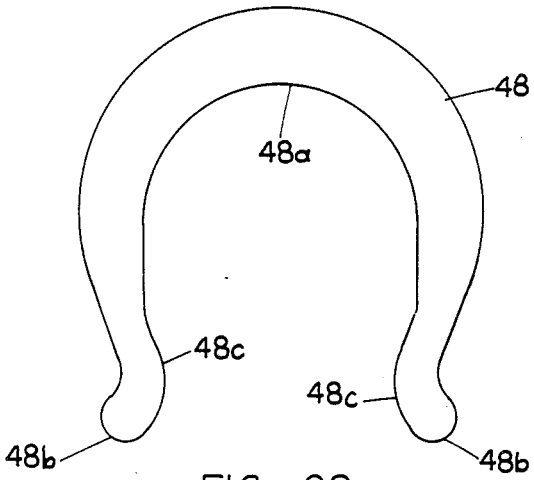
FIG. 28 is a plan view of a modified spacer.

The arrangement of FIGS. 26 through 28 discloses other modifications of the invention. The boss 50 is generally like that shown in FIG. 20. The spacer 48 of FIG. 28 is similar to the other spacers illustrated in that the distance between those leg ends 48*c* which are closest to each other is less than the outer diameter of the bit holder portion which they will have to pass while the inner curvature 48*a* is greater than such outer diameter. During installation, the leg ends 48*c* will first be forced about the bit holder portion 39 and then guided by the slanted boss surface 54*c* to a position where they will snap into position beneath the boss abutment surface 54*b* and thus secured within the boss 50.

In FIG. 27, the shortest distance 48*d* between the leg ends is slightly greater than the outer diameter of the bit holder portion about which they will pass during installation. These leg ends, however, will be moved toward one another as the end portions 48*b* pass by the boss portions 54*c* whereafter those end portions 48*b* will snap into position beneath such boss portions 54*c* as permitted by the boss notches 54*a*. This arrangement makes it possible for the installer to first move one leg end 48*b* into a notch 54*a* beneath a boss portion 54*c* and then to drive the other leg end home. This requires less alignment effort by the installer than do others of the modifications of this invention.

It will be apparent to those skilled in the art that modifications may be made in this invention without departing from the scope thereof. It is to be further understood, therefore, that while this invention has been described in connection with certain particular structures and arrangements, the invention is not to be limited to those particular structures and arrangements except insofar as they are specifically set forth in the subjoined claims.

What is claimed is:

1. In combination: a base member having a perforation to receive a bit holder, a bit holder to be inserted in said perforation, a retaining means for securing said bit holder in said base member, said retaining means being mountable on said bit holder, said base member being provided with a front face and a rear face, said perforation extending from said front face to said rear face, that part of said perforation adjacent said base member rear face being configured to cooperate with and at least partially receive and protect said retaining means, said bit holder having a head provided with a rear face adapted to engage said base member front face and a rear portion having exterior means to receive said retaining means, said bit holder being of a length to expose said exterior means for reception of said retaining means when said bit holder head rear face engages said base member front face, said bit holder also having a forward portion adjacent said head rear face; a spacer means being adapted to be inserted between said bit holder head rear face and said base member front face about said forward portion; whereby when said spacer is so inserted, said bit holder is positioned within said base member perforation such that said retaining means is at least in part received in and protected by said part of said base member perforation.

2. The combination of claim 1 in which said retaining means comprises a pin secured in said bit holder exterior means.

3. The combination of claim 1 in which said base member is provided with a boss on its said front face adjacent said perforation, said head having means to clear said boss, said spacer comprising a resilient split ring terminating in a pair of leg ends spaced from one another so as to just nicely pass around said bit holder forward portion without being spread apart, said leg ends having protrusions thereon, and said boss having recesses therein to receive said protrusions, said boss also having abutment means adjacent said recesses and so located as to require said leg ends to be forced toward one another to permit said protrusions to clear said abutments when said spacer is inserted between said bit holder head rear face and said base member front face, whereafter said leg ends and protrusions will snap into place within said recesses due to the resiliency of said split ring.

4. The combination of claim 1 in which said retaining means comprises a resilient split ring.

5. The combination of claim 1 in which said retaining means is secured in said bit holder exterior means.

6. The combination of claim 1 in which said spacer is a resilient split ring terminating in a pair of leg ends spaced from one another by a distance which is less than the outer dimension of said forward portion, whereby it is necessary to force said spacer on to said forward portion by causing said leg ends to spread apart whereafter such leg ends will move towards one another due to the resiliency of said split ring and thus secure said spacer on said forward portion.

7. The combination of claim 3 in which a pair of spaced-apart protuberances are provided on said base member front face adjacent said perforation and between which said leg ends are forced when said spacer is inserted, said leg ends having protrusions which are captured by said protuberances when said spacer is in its inserted position.

8. The combination of claim 3 in which said bit holder head is completely annular.

9. The combination of claim 3 in which said base member is provided with a boss on its said front face adjacent said perforation, said bit holder head having means to clear said boss, and said boss being positioned to be received between said leg ends whereby to prevent rotation of said spacer.

10. The combination of claim 9 in which said boss is provided with outer sides to be straddled by said leg ends.

11. The combination of claim 10 in which said outer sides of said boss are tapered.

12. The combination of claim 9 in which said boss is provided with an extension to be received between said leg ends and with a pair of arcuate recesses to receive said leg ends.

13. The combination of claim 12 in which said leg ends are provided with protrusions and said boss is provided with abutment means adjacent said recesses and over which said protrusions must be forced to gain access to said recesses as permitted by the resiliency of said ring.

14. The combination of claim 13 in which said protrusions are provided with guide surfaces on which said leg ends ride as said spacer is inserted between said bit holder head rear face and said base member front face.

15. The combination of claim 9 in which said means on said bit holder head to clear said boss comprises a flat on said head in line with the outer diameter of said forward portion of said head.

16. The combination of claim 9 in which said means on said bit holder head to clear said boss comprises a first, transverse notch to accommodate said boss.

17. The combination of claim 16 in which said head is annular.

18. The combination of claim 16 including a second, vertical notch in said head to receive means for prying said spacer off said bit holder forward portion.

19. The combination of claim 9 including a notch in said head to receive means for prying said spacer off said bit holder forward portion.

20. In combination: a base member having a perforation to receive a bit holder, a bit holder to be inserted in said perforation, a retaining means for securing said bit holder in said base member, said retaining means being mountable on said bit holder, a part of said base member perforation being configured to cooperate with and at least partially receive and protect said retaining means, and a spacer means, said spacer means being mountable on said bit holder to cooperate with said bit holder and base member to position said bit holder within said base member perforation such that said retaining means is at least in part received in and protected by said part of said base member perforation, said spacer comprising a resilient split ring terminating in a pair of leg ends spaced from one another by a distance which is less than the outer dimension of that part of said bit holder which is engaged thereby, whereby it is necessary to force said spacer on to said bit holder by causing said leg ends to spread apart whereafter such leg ends will move towards one another due to the resiliency of said split ring and thus secure said spacer on said bit holder.

21. The combination of claim 20 in which said retaining means comprises a pin secured in said bit holder.

22. The combination of claim 20 in which a pair of spaced-apart protuberances are provided on said base member adjacent said perforation and between which said leg ends are forced when said spacer is inserted between said bit holder and said base member, said leg ends having protrusions which are captured by said protuberances when said spacer is in its inserted, position.

23. The combination of claim 20 in which said bit holder is provided with a head which is completely annular, said head being adapted to abut said base member about said perforation.

24. The combination of claim 20 in which said retaining means comprises a resilient split ring.

25. The combination of claim 22 in which said retaining means is secured in said bit holder.

26. The combination of claim 20 in which said base member is provided with a boss adjacent said perforation, said bit holder having means to clear said boss, and said boss being positioned to be received between said leg ends whereby to prevent rotation of sad spacer.

27. The combination of claim 26 in which said boss is provided with outer sides to be straddled by said leg ends.

28. The combination of claim 27 in which said outer sides of said boss are tapered.

29. The combination of claim 26 in which said boss is provided with an extension to be received between said leg ends and with a pair of arcuate recesses to receive said leg ends.

30. The combination of claim 29 in which said leg ends are provided with protrusions and said boss is provided with abutment means adjacent said recesses and over which said protrusions must be forced to gain access to said recesses as permitted by the resiliency of said ring.

31. The combination of claim 30 in which said protrusions are provided with guide surfaces on which said leg ends ride as said spacer is inserted between said bit holder and said base member.

32. The combination of claim 26 in which said means on said bit holder to clear said boss comprises a flat on said bit holder adjacent said perforation.

33. The combination of claim 26 in which said bit holder is provided with a head which is adapted to abut said base member about said perforation, said means to clear said boss comprising a first notch in said head to accommodate said boss.

34. The combination of claim 33 in which said head is annular.

35. The combination of claim 33 including a second notch in said head to receive means for prying said spacer off said bit holder.

36. The combination of claim 25 in which said bit holder is provided with a head which is adapted to abut said base member about said perforation, said head including a notch to receive means for prying said spacer off said bit holder.

* * * * *